United States Patent [19]

Cossart

[11] 4,441,838

[45] Apr. 10, 1984

[54] ELEMENT FOR TUNNEL-TYPE METAL SHUTTERING

[75] Inventor: Alain M. Cossart, Paris, France

[73] Assignee: Metalex, Paris, France

[21] Appl. No.: 455,023

[22] Filed: Jan. 3, 1983

[51] Int. Cl.[3] ..... E21D 19/04; B28B 7/02

[52] U.S. Cl. ..... 405/150; 405/288; 405/290; 249/10

[58] Field of Search ..... 405/150, 146, 288, 290, 405/291; 299/11; 249/59, 62, 10, 11

[56] References Cited

U.S. PATENT DOCUMENTS

| | | | |
|---|---|---|---|
| 1,082,700 | 12/1913 | McArthur | 405/150 |
| 2,590,683 | 3/1952 | Clapp | 405/150 X |
| 3,115,754 | 12/1963 | Joseph | 405/297 |
| 3,298,155 | 1/1967 | Byfield et al. | 405/146 X |
| 3,601,996 | 8/1971 | Levy | 405/290 |
| 3,812,680 | 5/1974 | Walbrohl | 405/290 |
| 3,979,919 | 9/1976 | Blonde et al. | 405/146 |
| 4,143,991 | 3/1979 | Stafford | 405/291 |
| 4,173,421 | 11/1979 | Harhoff et al. | 405/288 X |
| 4,261,542 | 4/1981 | Lefebyre | 405/150 X |

FOREIGN PATENT DOCUMENTS

| | | | |
|---|---|---|---|
| 2710447 | 9/1978 | Fed. Rep. of Germany | 405/150 |
| 222436 | 10/1968 | U.S.S.R. | 405/146 |

*Primary Examiner*—Dennis L. Taylor

*Attorney, Agent, or Firm*—Cushman, Darby & Cushman

[57] ABSTRACT

There is described an element from tunnel-type metal shuttering, particularly retractable element and means associated with each panel adjacent the bottom thereof and controlled by the rigid structure as it is moved between both end positions thereof, to adjust the panel bottom position and the rolling means position relative to the ground, while insuring automatic levelling of the element in the shuttering position thereof, and means to join each panel from an element to the directly adjacent parallel panel from an element lying side by side when said elements lie in shuttering position.

11 Claims, 16 Drawing Figures

ELEMENT FOR TUNNEL-TYPE METAL SHUTTERING

This invention relates to an element from tunnel-type metal shuttering as described in Belgian Pat. No. 868,630, which element is retractable for shuttering and unshuttering cells from buildings with bearing cross-walls and solid concrete slab, comprising two vertical panels joined together by a flexible plating, means to retain said panels in parallel relationship and to vary the spacing thereof to bring said plating to a horizontal shuttering position or to a concave unshuttering position, said means being comprised of a rigid and undistortable structure extending between the element panels, guides secured to said panels and bearing said structure, and means bearing on the panels and structure to move said structure in parallel relationship therewith along a vertical direction, between two end positions corresponding to the shuttering position in which said structure bears the plating in horizontal position and the unshuttering position of said element, said guides having that portion thereof which cooperates with the structure lying at an angle to the panels in such a way that the slanting of those guide portions secured to the one panel be opposite to the slanting of the guides secured to the other panel, in such a way that the structure as it moves relative to the panels from the one end position to the other one, causes the spacing between said panels to vary, rolling means associated with each said panels adjacent the bottom thereof, to allow moving said element to the unshuttering position.

The shuttering element from the above-defined type comprises means such as jacks, which are regularly distributed at the panel bottom and which are so arranged as to adjust the position from said panel bottom relative to the ground, by bearing thereon, when the element lies in casting position, to insure the levelling of said element for such casting. Said jacks have to be operated one by one to obtain such adjustment of the panel bottom.

The invention has for object to provide a shuttering element which can be levelled automatically without any work by hand. For this purpose, means are associated with each panel adjacent the bottom thereof and said means are so controlled by the rigid structure as it is moved between both end positions thereof, as to adjust the panel bottom position and the rolling means position relative to the ground, while insuring automatic levelling of said element in shuttering position.

According to the invention, said rolling means are comprised of rollers idly mounted on shafts fast to the panels, at right angle thereto and equally spaced from the bottoms thereof, in such a way that said rollers project relative to the panel bottoms, said means to insure automatic levelling comprising at least adjacent each end of the bottom edge from said panels, a vertical-axis rod bearing on the lower end thereof, a horizontal flange which is to bear on the ground, supporting means for said rod secured to the corresponding shuttering panel and so arranged as to have said rod slidable along the axis thereof, a spring associated with said supporting means and rod to return said rod upwards, a bearing means so mounted as to be freely rotatable about a shaft which is fixed relative to the corresponding panel and having a substantially horizontal axis, the one means end lying on the one side of said shafts and cooperating with the upper rod end, and the other means end lying on the other shaft side and being located in the structure path, in such a way that said bearing means moves the rod downwards against the spring when the structure moves towards that position thereof corresponding to the element shuttering position and lets said rod move upwards under the spring action, when said structure moves towards that position thereof corresponding to the element unshuttering position, said rolling means and means for insuring automatic levelling being moreover so arranged that when said structure lies in that position thereof corresponding to the element shuttering position, the rod flanges bear on the ground, and when said structure lies in that position thereof corresponding to the element unshuttering position, said rollers engage the ground and the rod flanges are raised from such ground.

The invention has also for object to provide a shuttering element the rigid structure of which can be fixed in position relative to the panels during casting, to prevent any movement of the plating and of the panels relative to one another during such casting.

According to the invention, means are provided to join each element panel to that parallel panel which is directly adjacent in an element which lies next to said element when said elements lie in shuttering position, the panels from the various elements allowing to make adjacent cells on one and the same level, being thus joined together to obtain an undistortable unit (platings, panels and rigid structures) which prevents any flaw in the casting.

According to the invention, said element may further comprise locking means so arranged as to insure automatic locking of the rigid structure relative to the panels when the element lies in shuttering position, said latter means further increasing the undistortable nature of an element and said unit in shuttering position.

According to the invention, said rigid structure and plating from the element are so arranged as to make it possible to vary the spacing between the element panels to adjust such spacing according to the shuttering to be obtained.

Other details and features of the invention will stand out from the following description, given by way of non limitative example and with reference to the accompanying drawings, in which.

Figure 5:
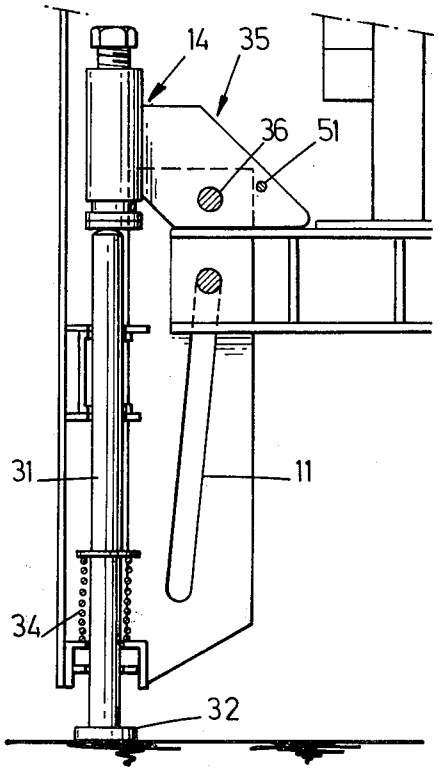
FIGS. 3 to 5 are detail views in elevation, on a larger scale, showing the means allowing to adjust the position of the panel bottom, FIGS. 3 and 5 showing said means respectively in unshuttering position and shuttering position of the element, FIG. 4 showing said means in an intermediate position.
Figure 4:
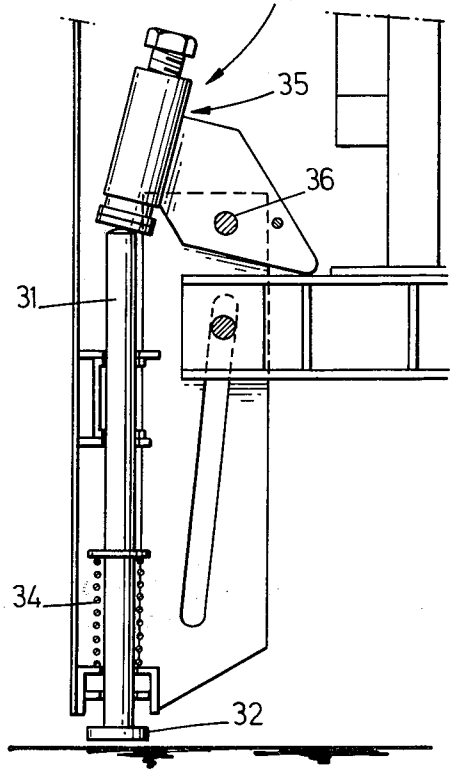
Figure 3:
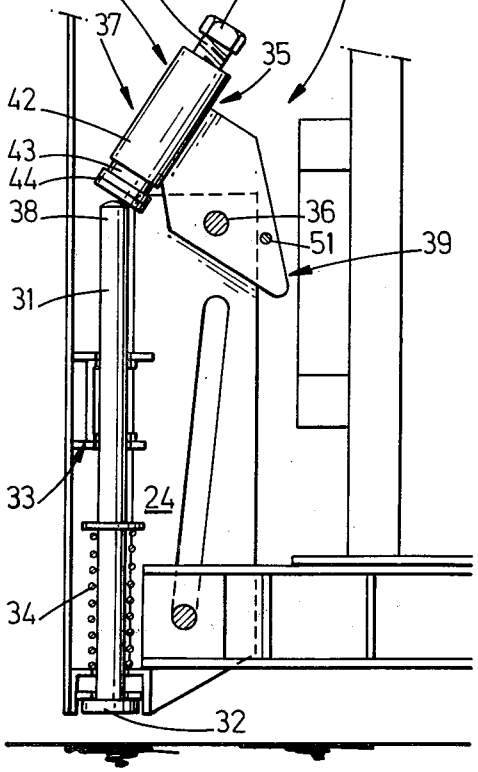
Figure 6:
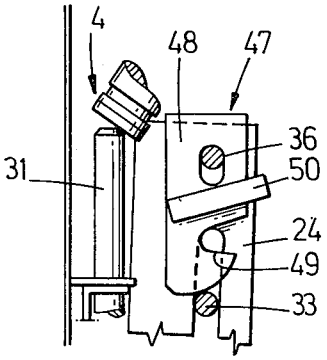
FIG. 6 is a detail view in elevation and with parts broken away, showing the automatic locking means for the structure as associated with the adjusting means shown in FIG. 3.
Figure 7:
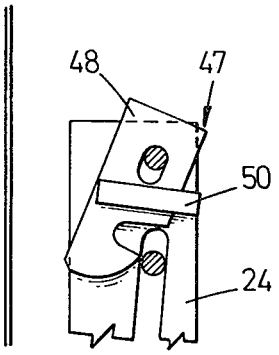
Figure 8:
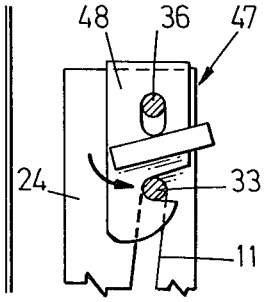

FIGS. 7 and 8 correspond to FIGS. 4 and 5 and show the locking means in that position they lie in when the shuttering element lies in the intermediate position as shown in FIG. 4 and when the element lies in shuttering position as shown in FIG. 5.

Figure 9:
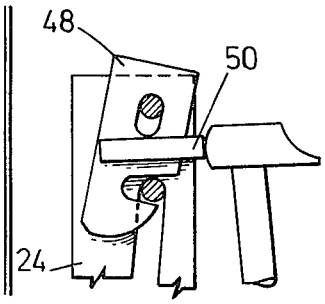
Figure 10:
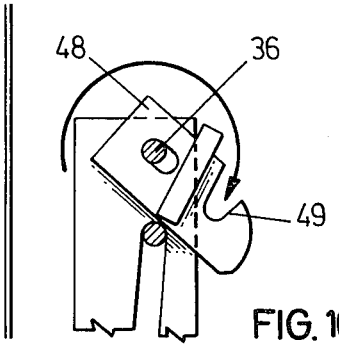

FIGS. 9 and 10 show the disabling of the locking means to allow bringing the element to the unshuttering position.

Figure 11:
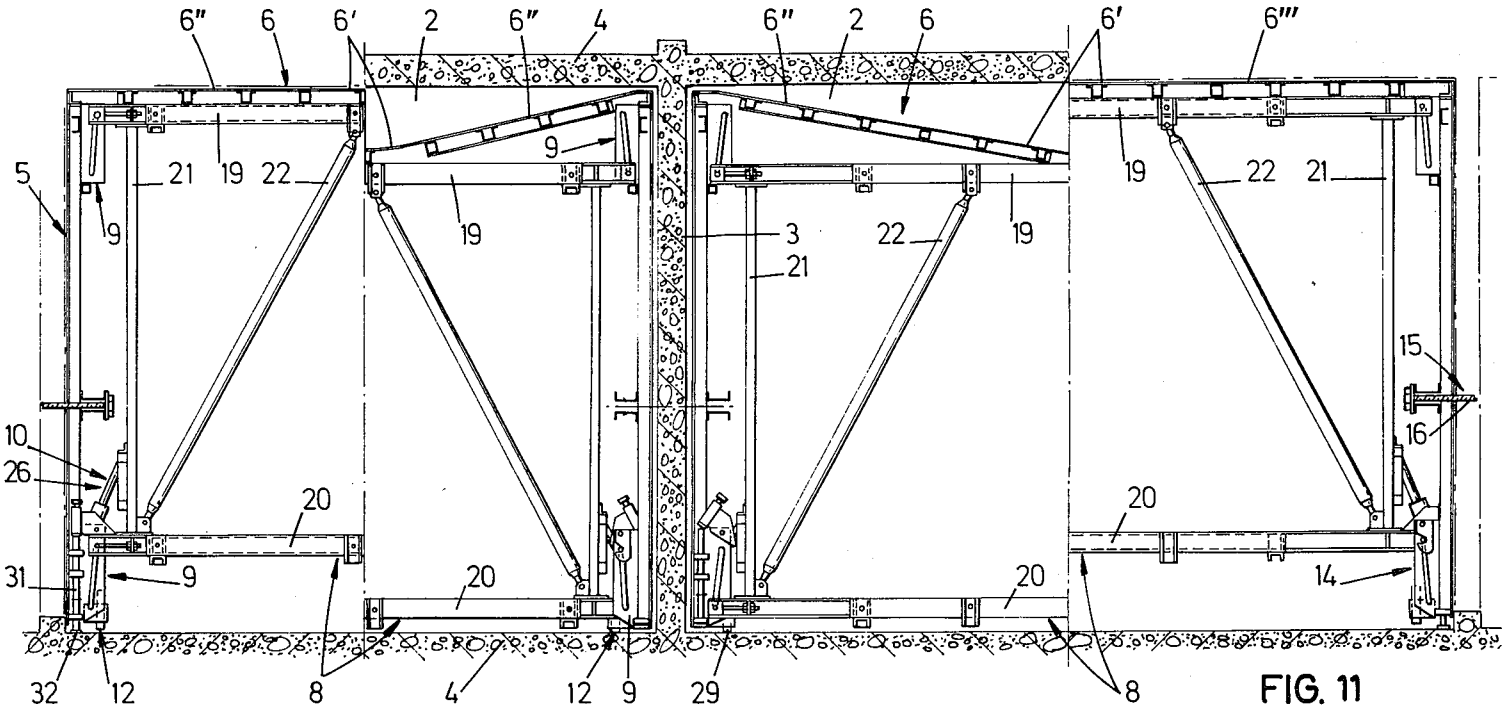

FIG. 11 is an elevation view showing two shuttering elements as arranged in two directly adjacent cells with different lengths, each said element being shown partly in shuttering position and in unshuttering position.

Figure 12:
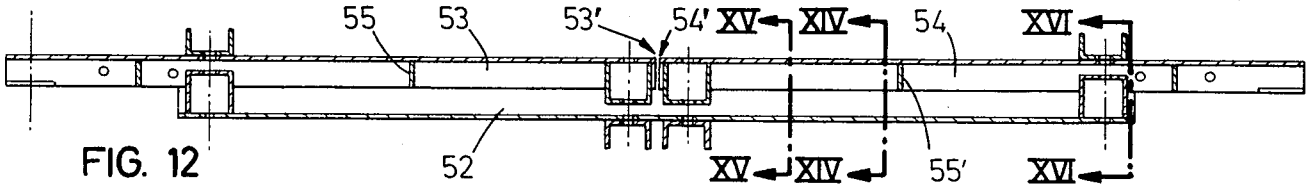
Figure 13:
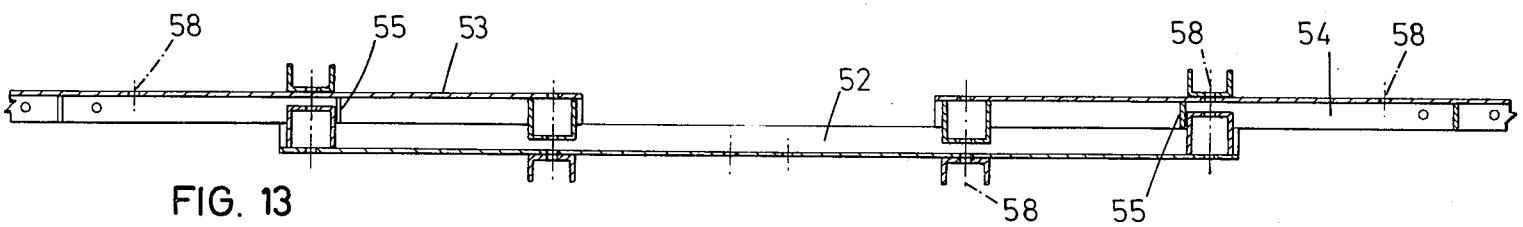

FIGS. 12 and 13 are detail plan views of the shuttering elements shown in FIG. 11.

Figure 16:
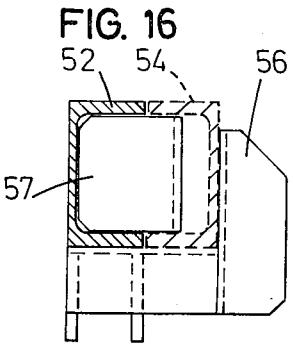
Figure 15:
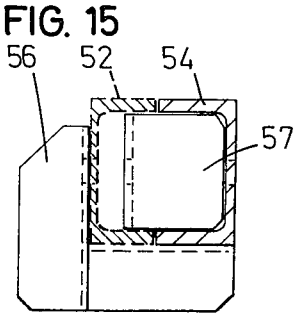
Figure 14:
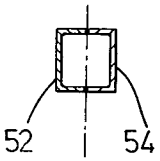

FIGS. 14 to 16 are side and section views along the lines XIV—XIV to XVI—XVI in FIG. 12.

In the various figures, the same reference numerals pertain to identical or similar elements.

Figure 1:
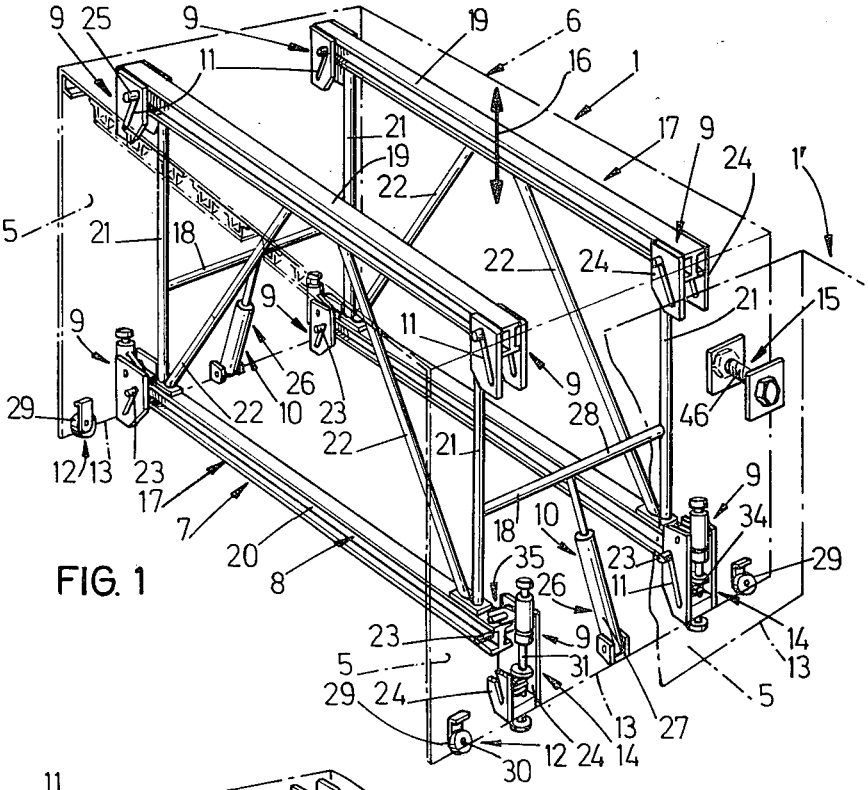
FIG. 1 is a diagrammatic view in perspective and with parts broken away, showing a shuttering element according to the invention in shuttering position, the panels and plating from said element being shown in dotted lines, said element being associated with an adjacent element lying side by side and shown but partly.
Figure 2:
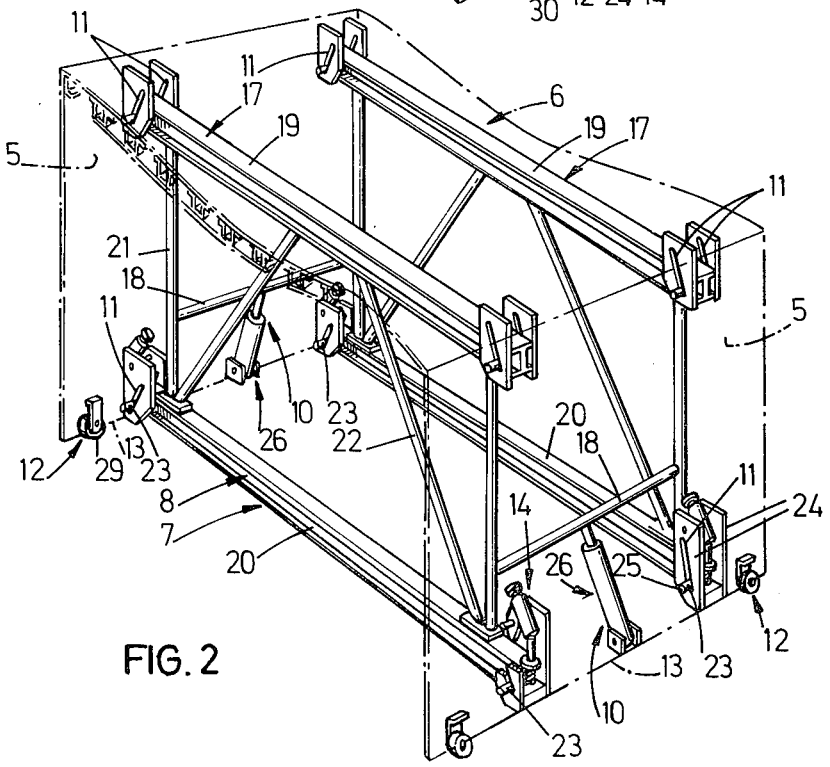
FIG. 2 is a view similar to FIG. 1, the element being shown in unshuttering position, while the adjacent element is not shown.

The shuttering element 1 according to the invention and as shown in the drawings, is a retractable element of tunnel type which is intended for shuttering and unshuttering cells 2 from buildings with bearing cross-walls 3 and solid concrete slab 4. Said shuttering element comprises two vertical shuttering panels 5 joined together by a flexible plating 6, means 7 for retaining said panels 5 in parallel relationship and for causing the spacing thereof to vary to bring said plating to a horizontal shuttering position (FIG. 1) or to a concave unshuttering position (FIG. 2), which means are comprised of a rigid undistortable structure 8 extending between the element panels, guides 9 fast to said panels 5 and bearing said structure 8, and means 10 bearing on said panels 5 and structure 8 to move said structure in parallel relationship therewith along a vertical direction, between two end positions corresponding to the shuttering position in which said structure bears the plating 6 in horizontal position, and the element unshuttering position, said guides 9 having the portion 11 thereof which cooperates with the structure 8 lying at an angle relative to panels 5 in such a way that the slanting of portions 11 from those guides 9 secured to the one panel be opposite to the slanting of those guides fast to the other panel, in such a way that the structure as it moves relative to the panels from the one end position thereof to the other one, causes the spacing between said panels 5 to vary, rolling means 12 associated with each panel 5, adjacent the bottom 13 thereof, to make it easier to move the element to the unshuttering position, means 14 associated with each panel 5 adjacent the bottom 13 thereof and controlled by said rigid structure 8 as it is moved between both end positions thereof, to adjust the position of said panel bottom 13 and rolling means 12 relative to the ground, while insuring the automatic levelling of element 1 in shuttering position, and means 15 to join each said panels 5 from an element 1 to the directly adjacent panel from an element 1' (FIG. 1) lying side by side when both said elements 1 and 1' lie in shuttering position.

The rigid structure 8 the vertical movement of which along double arrow 16 (FIG. 1) causes the element 1 to go from the unshuttering position to the shuttering position thereof and vice-versa, is comprised of two parallel frames 17 extending vertically and at right angle to said panels 5, joined together by linking rods 18 and each comprised of two horizontal cross-beams 19 and 20 with the same length, joined together adjacent the ends thereof, by substantially vertical connecting rods 21 strengthened by braces 22 secured to said cross-beams 19 and 20. Each end of said cross-beams 19 and 20 comprises an element 23 at right angle to the cross-beam for cooperating with the portion 11 from said guides 9 on the one hand to have said structure 8 supported by said guides, and on the other hand to have said structure be so guided as to be movable inside said portions 11 of guides 9 by said means 10, to bring the panels 5 and flexible plating 6 from element 1 either to the shuttering position or the unshuttering position, the horizontal cross-beams 19 from the frames 17 contacting the plating 6 in the shuttering position of element 1, to bear same in an accurately horizontal position. Each guide 9 is comprised of two metal sheets 24 assembled at right angle to the panels 5, guide portions 11 being comprised of parallel recesses in the shape of slides, which lie at an angle relative to the corresponding panel and which are to receive the ends 25 from elements 23 fast to the cross-beams 19 and 20 from said structure 8.

The beams 10 bearing on the panels 5 and structure 8 to move said structure between both end positions thereof, are comprised of two jacks 26, such as pressurized-fluid jacks. The cylinder 27 in each said jacks is hinged to the one panel 5, while the free end of piston rod 28 is fast to the corresponding connecting rod 18 joining both parallel frames 17 from said structure 8, the axes of said jacks 26 lying substantially in a vertical plane in parallel relationship with said frames 17 and the spacings between said vertical plane and the frames being substantially equal.

Said rolling means 12 which are intended to make it easier to move element 1 to the unshuttering position, on the one hand for bringing the element in position fot the casting of cells 2, and on the other hand to release said element 1 from said cells 2 after such casting, are comprised of rollers 29 idly mounted on shafts 30 secured to panels 5 at right angle thereto and with an equal spacing from the bottoms 13 thereof, in such a way as to have said rollers 29 project relative to said panel bottoms 13. Said means 14 allowing to adjust the level of panel bottoms 13 in the element shuttering position, and insuring automatic levelling of said element, comprise adjacent each end of said panel bottoms 13, a rod 31 with a vertical axis, bearing at the lower end thereof, a horizontal flange or base-plate 32 which is to bear on the ground, supporting means 33 for the rod fast to the corresponding panel 5 and so arranged as to have the rod slidable along the axis thereof, a spring 34 associated with said supporting means 33 and rod 31 to return said rod upwards, a bearing means 35 so mounted as to be freely rotatable about a shaft 36 fixed relative to the corresponding panel 5 and having a substantially vertical axis, with an end 37 lying on the one side of said shaft 36 for cooperating with the top end 38 of rod 31, and an end 39 lying on the other side of shaft 36 which is arranged in the path of the corresponding cross-beam 20 from structure 8, in such a way that said bearing means 35 moves the rod 31 downwards against spring 34 when the structure 8 moves to that position thereof corresponding to the shuttering position of element 1, and lets the rod 31 move upwards under the action of spring 34 when said structure 8 moves to that position thereof corresponding to the unshuttering position of said element, said rolling means 12 and means 14 being moreover so arranged as to have when the structure 8 lies in the position thereof corresponding to the shuttering position of element 1, the flanges 32 of rods 31 bearing on the ground, and the rollers 29 being raised from such ground, and when the structure lies in the position thereof corresponding to the element unshuttering position, to have the rollers 29 contacting the ground and the rod flanges 32 be raised therefrom.

As the first slab 4 from the building is not cast by means of elements 1, said slab may have differences in the level thereof. To compensate for such level differences during the casting of the cells over said first slab and to obtain an accurately horizontal top slab, said means 14 are so arranged as to make possible a change in the position (zero level) from each rod flange 32. For this purpose, said bearing means 35 associated with each rod 31, has adjacent that end 37 thereof cooperating with the top rod end 38, means 40 so arranged as to allow adjusting the position of said end 37 relative to the top rod end. Said means 40 are for instance comprised of an adjusting screw 41 mounted into a threaded bushing 42 fast to said bearing means 35, said screw having at the end 43 thereof, an element 44 for contacting the rod, and at the other end thereof, a head 45 with cut-off corners allowing to control the screw movement inside the bushing 42.

To fix said element structure 8 in position relative to panels 5 and plating 6 during casting and setting of the concrete, said means 15 are comprised of screw-bolts 46 joining together the corresponding panels from elements lying side by side to make a row of cells 2. To strengthen such fixing in position of the structure relative to said panels and plating, the element according to the invention advantageously comprises locking means 47 so arranged as to insure automatic locking of the structure 8 as it moves from the element unshuttering position to the shuttering position. Said locking means 47 comprise adjacent each end of the panel bottoms 13, a bolt 48 swinging freely about said horizontal shaft 36 and lying in the path of element 33 from the corresponding cross-beam 20, with such a profile as to be rotated about said shaft by said element 33 to let said structure 8 pass through as it moves to that position thereof corresponding to the element shuttering position, and to be able to return under the action of the weight thereof to such a position as to fix said structure 8 in that position thereof corresponding to the element shuttering position. Such fixing in position is performed by automatically pushing said element 33 into a cut-out 49 provided in the bolt as the structure moves upwards, the release of element 33 from the bolt, to return element 1 to the unshuttering position, being obtained as shown in FIG. 9, by pushing on bolt part 50.

To protect levelling means 14 and locking means 47, said means are advantageously arranged between two metal sheets 24 comprising each said guides 9, shaft 36 being supported by said sheets.

To insure an ever-accurate position of said bearing means 35 relative to rods 31, each said means 35 comprises at the end 39 thereof lying in the path of the corresponding structure cross-beam 20, a stop 51 cooperating with bolt part 50 to limit the stroke of bearing means 35 when said structure 8 moves to that position thereof corresponding to the element unshuttering position, to have bearing means end 37 cooperating with end 38 of rod 31 remain engaging said rod as it is pushed back upwards by spring 34.

According to the invention, to allow adapting the width of elements 1 to the width of cells 2 to be made, each cross-beam 19, 20 from structure 8 is comprised of an assembly from three profile sections, a center section 52 and two end sections 53,54 which are slidable relative to one another along the lengthwise axes thereof, in a telescopic way, to adapt the length thereof to the width of the shuttering position to be obtained. When the shuttering is used with the shortest width thereof, sections 53 and 54 bear on one another through the ends 53' and 54' thereof (FIG. 12), while when the shuttering is used with the largest width thereof, the movement of said sections 53 and 54 is limited by end stops 55 and 55' (FIG. 13). Said profile sections 52, 53 and 54 from each cross-beam 19,20 are linked and guided by yokes 56 and guides 57, while means such as screw-bolts sketched with axis lines 58, are provided to fix said sections relative to one another in the selected position thereof. The connection points of the connecting rods 21 and braces 22 lie on the end sections 53 and 54 from the cross-beams. The element plating 6 is comprised as shown in FIG. 11, of three parts 6',6" and 6''' extending at right angle to the cross-beams 19 and 20, two equal side platings 6" and 6''' secured to panels 5 from said element, and a center removable plating 6' the size of which in parallel relationship with said cross-beams 19 and 20, is selected according to the remaining space between said side platings 6" and 6''' when the length of said structure cross-beams 19 and 20 has been adapted to the width of the shuttering to be obtained, said center plating 6' being secured to said cross-beams. Means not shown may also be provided on elements 1 to join same together when a plurality of elements is aligned for casting one and the same cell 2.

It must be understood that the invention is in no way limited to the above embodiments and that many changes may be brought therein without departing from the scope of the invention as defined in the appended claims.

I claim:

1. Element from tunnel-type metal shuttering, particularly retractable element for shuttering and unshuttering cells from buildings with bearing cross-walls and solid concrete slab, comprising two vertical panels joined together by a flexible plating, means to retain said panels in parallel relationship and to vary the spacing thereof to bring said plating to a horizontal shuttering position or to a concave unshuttering position, said means being comprised of a rigid and undistortable structure extending between the element panels, guides secured to said panels and bearing said structure, and means bearing on the panels and structure to move said structure in parallel relationship therewith along a vertical direction, between two end positions corresponding to the shuttering position in which said structure bears the plating in horizontal position and the unshuttering position of said element, said guides having that portion thereof which cooperates with the structure lying at an angle to the panels in such a way that the slanting of those guide portions secured to the one panel be opposite to the slanting of the guides secured to the other panel, in such a way that the structure as it moves relative to the panels from the one end position to the other one, causes the spacing between said panels to vary, rolling means associated with each said panels adjacent the bottom thereof, to allow moving said element to the unshuttering position, and means associated with each panel adjacent the bottom thereof and controlled by the rigid structure as it is moved between both end positions thereof, to adjust the panel bottom position and the rolling means position relative to the ground, while insuring automatic levelling of the element in the shuttering position thereof, and means to join each panel from an element to the directly adjacent parallel panel from an element lying side by side when said element lie in shuttering position.

2. Shuttering element as defined in claim 1, in which said rolling means are comprised of rollers idly mounted on shafts fast to the panels, at right angle thereto and equally spaced from the bottoms thereof, in such a way that said rollers project relative to the panel bottoms, said means to insure automatic levelling comprising at least adjacent each end of the bottom edge from said panels, a vertical-axis rod bearing on the lower end thereof, a horizontal flange which is to bear on the ground, supporting means for said rod secured to the corresponding shuttering panel and so arranged as to have said rod slidable along the axis thereof, a spring associated with said supporting means and rod to return said rod upwards, a bearing means so mounted as to be freely rotatable about a shaft which is fixed relative to the corresponding panel and having a substantially horizontal axis, the one means end lying on the one side of said shaft and cooperating with the upper rod end, and the other means end lying on the other shaft side and being located in the structure path, in such a way that said bearing means moves the rod downwards against the spring when the structure moves towards that position thereof corresponding to the element shuttering position and lets said rod move upwards under the spring action, when said structure moves towards that position thereof corresponding to the element unshuttering position, said rolling means and means for insuring automatic levelling being moreover so arranged that when said structure lies in that position thereof corresponding to the element shuttering position, the rod flanges bear on the ground, and when said structure lies in that position thereof corresponding to the element unshuttering position, said rollers engage the ground and the rod flanges are raised from such ground.

3. Shuttering element as defined in claim 2, in which said bearing means associated with each said rods is provided at the end thereof cooperating with said top rod end, with means so arranged as to allow adjusting the position of said end relative to the top rod end.

4. Shuttering element as defined in claim 1, which further comprises locking means for insuring automatic locking of said rigid structure relative to said panels when the element lies in the shuttering position.

5. Shuttering element as defined in claim 4, in which said locking means comprise at least next to each end from the panel bottoms, a bolt swinging freely about a horizontal shaft and lying in the path of said rigid structure, said bolt being so shaped as to be rotatable about said shaft under the action of said structure, to let said structure pass through as it moves to that position thereof corresponding to the shuttering position, and to return under the action of the weight thereof, to such a position as to lock the structure in that position thereof corresponding to the element shuttering position.

6. Shuttering element as defined in claim 5, in which the bearing means associated with each rod from the automatic element levelling means and the corresponding bolt from the locking means are mounted on one and the same shaft.

7. Shuttering element as defined in claim 6, in which the bearing means comprises at the end thereof lying in the structure path, a stop cooperating with the bolt to limit the bearing means stroke as the structure moves to the element unshuttering position thereof, to cause that bearing means end cooperating with the rod end to remain engaging said rod as it is returned upwards by said spring.

8. Shuttering element as defined in claim 1, in which said rigid structure is comprised of at least two parallel frames extending vertically at right angle to the panels, said frames being joined together by connecting rods and being each comprised of at least two horizontal cross-beams with the same length, joined together adjacent the ends thereof by substantially vertical connecting rods strengthened by braces secured to said cross-beams, each end of said cross-beams comprising an element extending at right angle to the cross-beam, said guides being each comprised of two vertical metal sheets assembled at right angle to the panels, parallel recesses lying at an angle to the panels, being provided in said sheets to receive the ends of elements secured to the cross-beams and insure supporting of the structure as well as the guiding thereof as it moves from the one end position thereof to the other one.

9. Shuttering element as defined in claim 8, in which said means bearing on the panels and on the structure to move said structure between both ends thereof are comprised of at least two jacks, such as pressurized-fluid jacks, the cylinder of each jack being hinged to the one panel, while the free piston rod end is fast to the corresponding connecting rod joining together both said parallel frames from the structure, the jack axes lying substantially in a vertical plane in parallel relationship with said frames, the spacings between said vertical plane and frames being substantially equal.

10. Shuttering element as defined in claim 8, in which the means for insuring automatic levelling and the means for insuring automatic locking are arranged between both vertical sheets forming each one of said guides for the rigid structure.

11. Shuttering element as defined in claim 8, in which each structure cross-beam is comprised of an assembly from three profile sections, a center section and two end sections which are slidable relative to one another along the lengthwise axes thereof in a telescopic way, to adapt the cross-beam length to the shuttering to be obtained, means being provided to fix the sections relative to one another in the selected position thereof, the assembling points of the connecting rods and braces lying on the end sections, the element plating being comprised of three parts extending at right angle to the cross-beams, two equal side platings secured to the element panels and a center removable plating the size of which in parallel relationship with the cross-beams, being selected according to the space remaining between said side platings when the structure cross-beam length has been adapted to the shuttering to be obtained, means being provided to secure said center plating to said cross-beams.

* * * * *